United States Patent [19]

McIntire et al.

[11] 4,184,473

[45] Jan. 22, 1980

[54] IMPROVED MOBILE HOME HEATER

[76] Inventors: Kendrick H. McIntire, Rte. 2, Box 1000; John E. McIntire, Rte. 2, Box 151-A, both of Aurora, Oreg. 97002

[21] Appl. No.: 880,702

[22] Filed: Feb. 23, 1978

[51] Int. Cl.[2] ..... F24B 5/00; F23J 11/00

[52] U.S. Cl. ..... 126/77; 98/48; 126/63; 126/66; 126/121; 126/136; 126/312; 126/126

[58] Field of Search ..... 126/77, 76, 312, 143, 126/85 B, 121, 126, 131, 136, 63, 193, 293, 66; 98/48

[56] References Cited

U.S. PATENT DOCUMENTS

| | | | |
|---|---|---|---|
| Re. 176 | 9/1850 | Atwood | 126/77 |
| 193,690 | 7/1877 | Chase | 126/77 |
| 596,286 | 12/1897 | Mickel et al. | 126/312 |
| 646,863 | 4/1900 | McNaughton et al. | 126/77 |
| 763,476 | 6/1904 | Garrison | 126/312 |
| 804,140 | 11/1905 | Lahan | 126/77 |
| 1,136,615 | 4/1915 | Rice | 126/77 |
| 1,186,303 | 6/1916 | Frost | 98/48 |
| 1,561,497 | 11/1925 | Wier | 126/77 |
| 1,644,900 | 10/1927 | Sperry | 126/77 |
| 1,798,431 | 3/1931 | McWilliams | 126/293 |
| 2,114,772 | 4/1938 | Althoff | 126/77 |
| 2,375,318 | 5/1945 | Mudgett | 126/143 |
| 4,015,579 | 4/1977 | Wirth | 126/121 |
| 4,043,313 | 8/1977 | Sherman | 126/121 |
| 4,089,320 | 5/1978 | Brown et al. | 126/121 |
| 4,117,827 | 10/1978 | Billmeyer | 126/121 |
| 4,121,560 | 10/1978 | Knight | 126/67 |
| 4,141,336 | 2/1979 | Fitch | 126/126 |

*Primary Examiner*—Samuel Scott
*Assistant Examiner*—Daniel J. O'Connor
*Attorney, Agent, or Firm*—Klarquist, Sparkman, Campbell, Leigh, Hall & Whinston

[57] ABSTRACT

The specification discloses a mobile home heater taking combustion air from the outside and operable selectively as a stove and a fireplace and being double walled in its back sides and bottom. In operation as a stove, combustion air flows into a bottom passage covering the bottom of the fire chamber, up a back passage covering the back of the fire chamber and down a preheating passage in the back passage and into the lower portion of the fire chamber, secondary air also flowing from the back passage into the upper portion of the fire chamber. For fireplace operation, a door is opened to the fire chamber and also opens ports from the bottom passage to supply air through the door opening, a thermostat controlled damper to the preheating passage closing. An injection tube leads from the back passage into a stack to minimize condensation in low combustion operation, and a second air injection tube in the upper portion of the stack has a thermostat controlled inlet valve closed when the stack is hot.

9 Claims, 9 Drawing Figures

FIG. 1
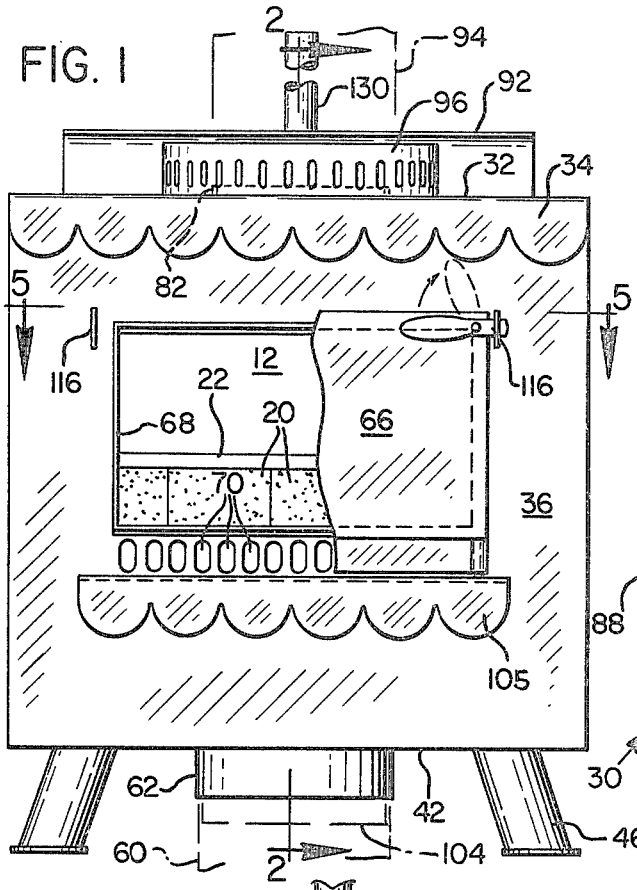
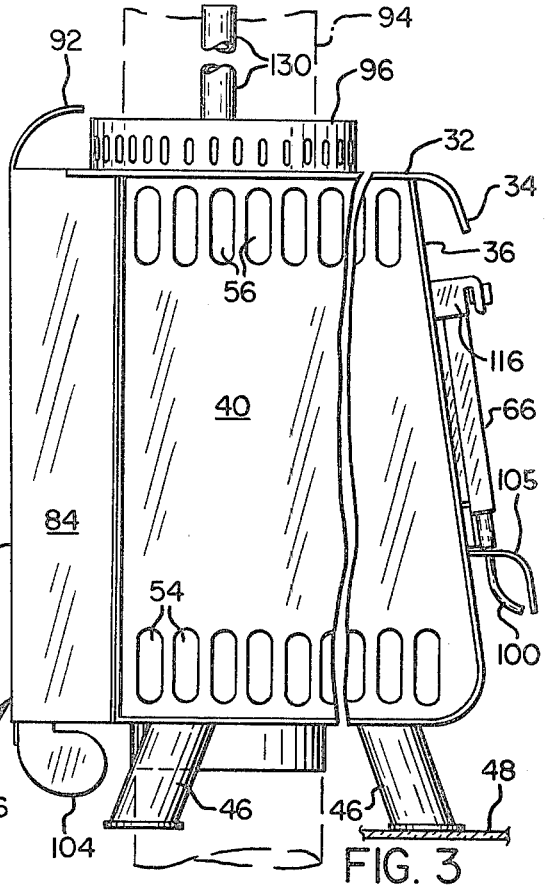
FIG. 3
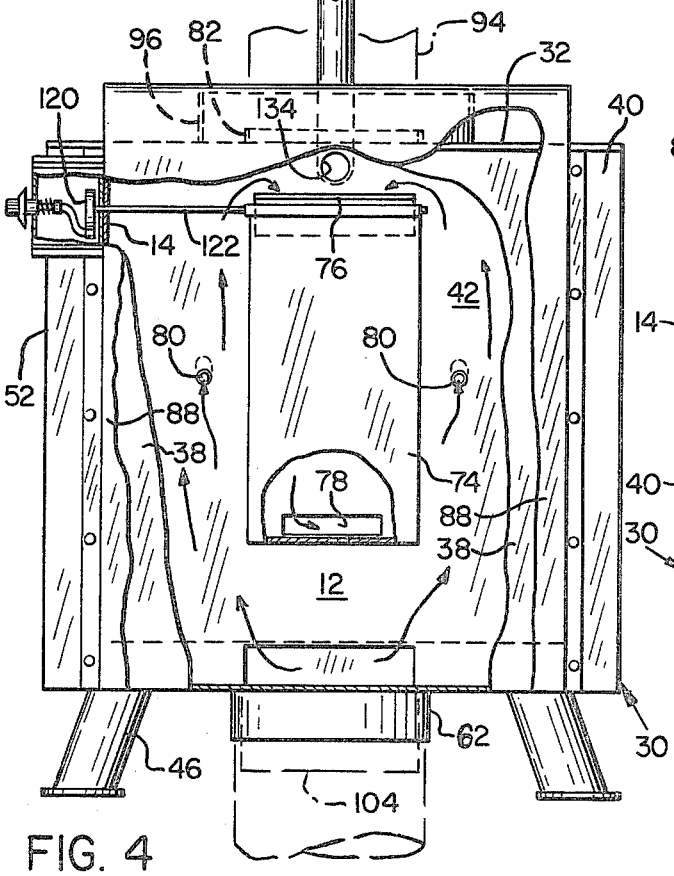
FIG. 4
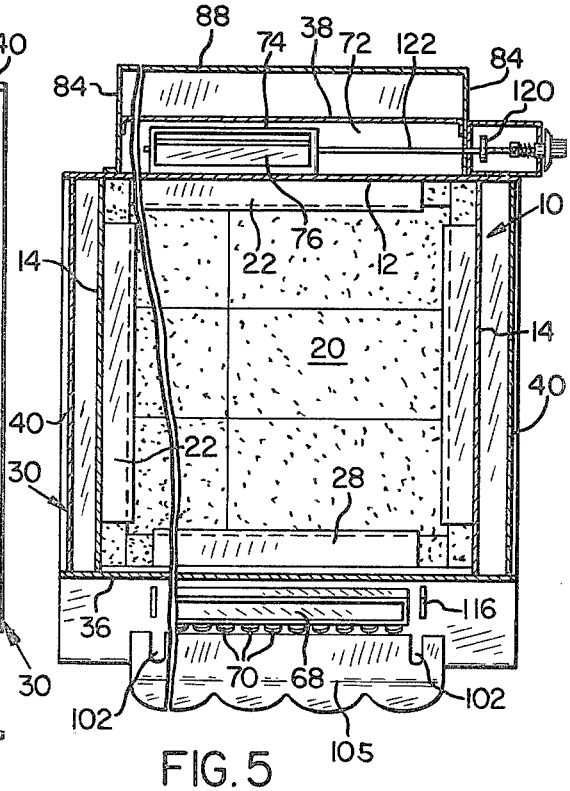
FIG. 5

FIG. 6
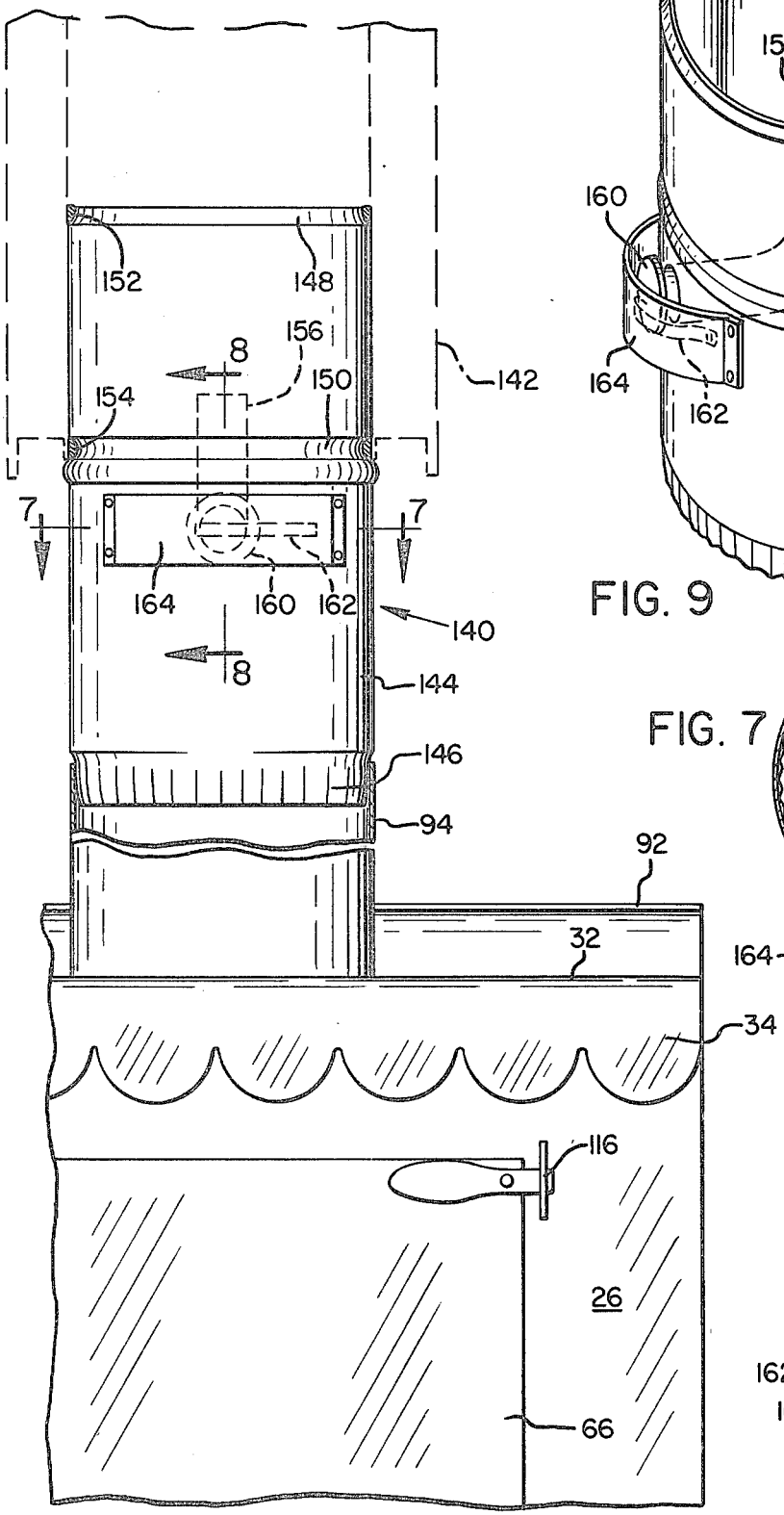
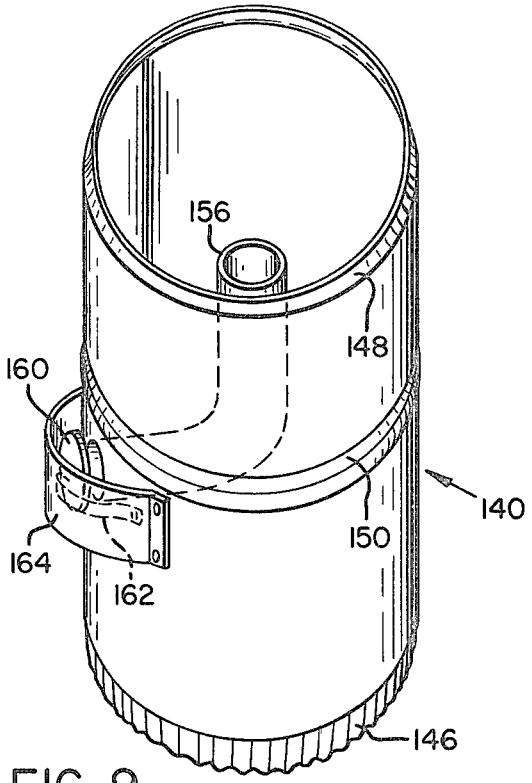
FIG. 9
FIG. 7
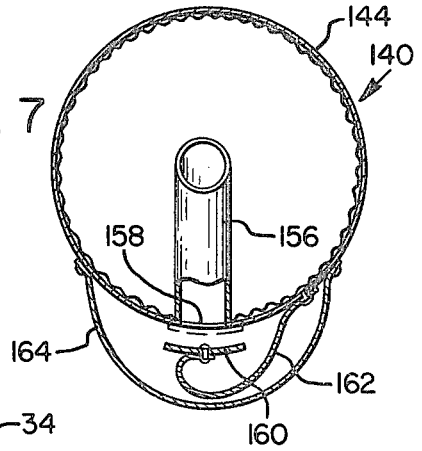
FIG. 8
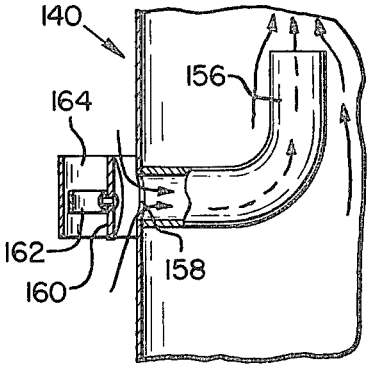

IMPROVED MOBILE HOME HEATER

DESCRIPTION

This invention relates to a new and improved stove, and has for an object thereof the provision of a new and improved stove.

Another object of the invention is to provide a combined stove and fireplace suitable for operation in a mobile home.

A further object of the invention is to provide a stove having convection heating passages along its back and sides.

Another object of the invention is to provide a stove having a combustion air supply to its fire chamber in which the air is preheated as it travels under the bottom of the fire chamber and along the back of the fire chamber.

Another object of the invention is to provide a heater operable as a stove when a door thereof is closed and a fireplace when the door is open, the door serving to close air ports to the door opening from an air supply during stove operation and to open the ports during fireplace operation.

Another object of the invention is to provide a stove having an air injection tube leading from an air supply of the stove into a stack to keep air moving in the stack during low combustion to minimize condensation.

Another object of the invention is to provide a heater construction in which a stack pipe is sealed by furnace cement seals in a chimney and has an air injection tube with a thermostatic controlled inlet valve.

Another object of the invention is to provide a combined fireplace and stove which serves not only as a heater but also as a thermostat controlled cooking stove.

In the drawings:

FIG. 1 is a front elevation view of an improved stove forming one embodiment of the invention;

FIG. 3 is a side elevation view of the stove of FIG. 1.

FIG. 4 is a partially sectional, rear elevation view of the stove of FIG. 1;

FIG. 5 is a horizontal section taken along line 5—5 of FIG. 1;

FIG. 6 is an enlarged, fragmentary, front elevation view of the stove of FIG. 1 with an auxiliary draft;

FIG. 7 is a horizontal section taken along line 7—7 of FIG. 6;

FIG. 8 is a fragmentary, vertical section taken along line 8—8 of FIG. 6; and,

FIG. 9 is a perspective view of the auxiliary draft.

Figure 2:
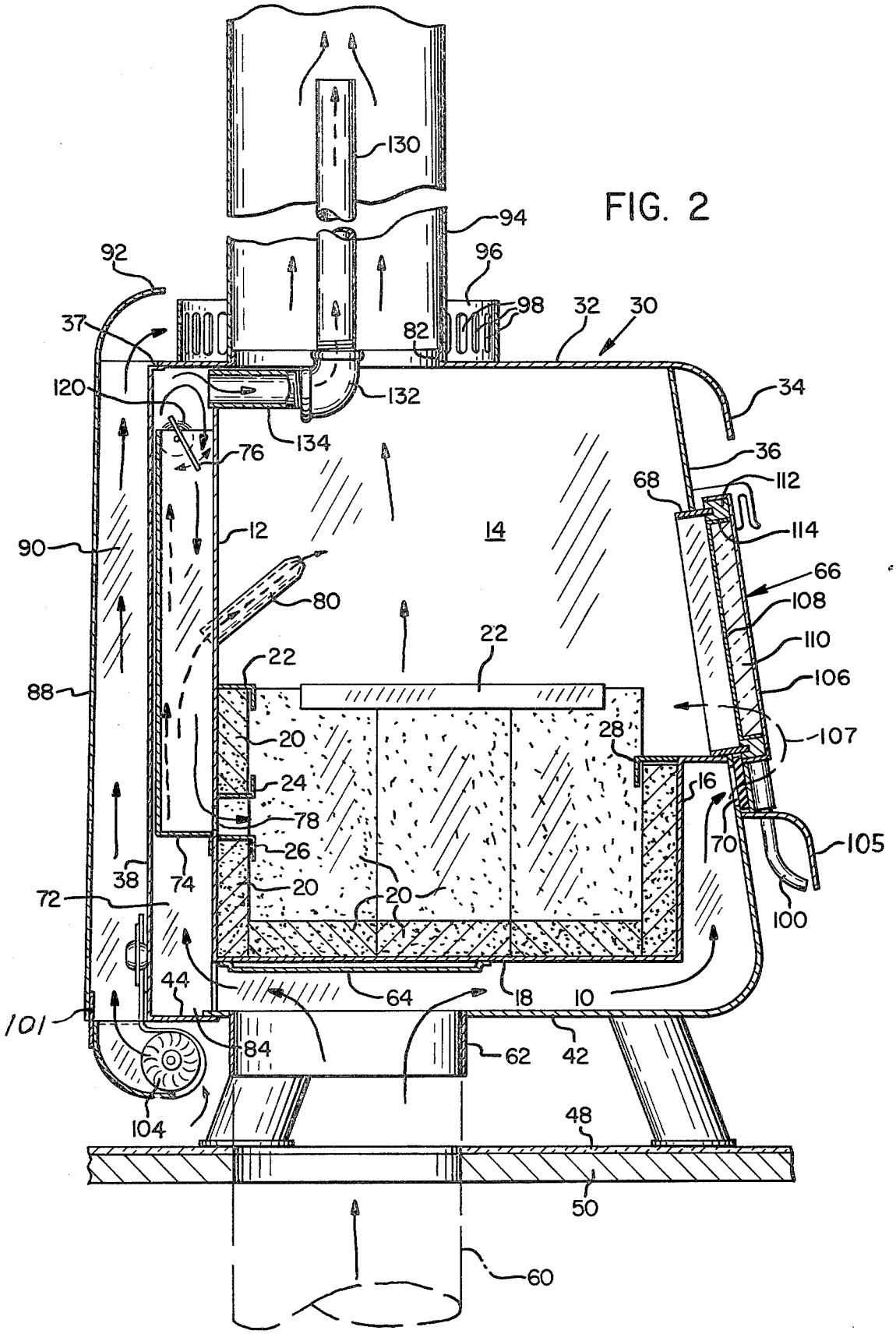
FIG. 2 is an enlarged, vertical, sectional view taken along line 2—2 of FIG. 1.

An improved stove forming a specific embodiment of the invention is an airtight stove providing outside combustion air and thus well adapted for use as a mobile home heater, and includes an inner body or shell 10 (FIG. 2) having back, side and front walls 12, 14 and 16, respectively. The inner body 10 also includes a bottom wall 18. Fire brick 20 covers the bottom wall 18, the front wall 16 and about the lower half of the back wall 12 and is retained on the front side and back walls by angle members 22, 24, 26 and 28 welded to the back and front walls. An outer body or shell 30 includes a top 32 having a rolled front lip 34 and welded to a front 36 thereof. The top also is welded to the top of wall 12 and to sides 14 and 40 of the inner and outer shells. A bottom 42 forms a continuation of the front 36 and is welded to the bottom of the back 12 and to the side walls 14 and the sides 40. Legs 46 support the stove above asbestos pad 48 on a floor 50 of a mobile home. The flanged outer shell side walls 40 are spaced from the side walls 14 and have lower air inlet openings 54 and upper air outlet openings 56.

An inlet pipe 60 extends through the floor 50 and the pad 48 and is coupled to a flanged connector pipe 62 welded to the bottom 42, a cupped protector plate 64 secured to bottom wall 18 spaced upwardly from and covering the entire opening in the pipe 62. With a door 66 closed and closing door opening frame 68 and also closing air holes 70 in the front wall 36, as shown in FIG. 2, air flows from the pipe 62 into enclosed passage 72, up past a downdraft preheating manifold 74, past damper plate 76, down through the manifold 74 and through inlet opening 78 to burning fuel (not shown) on the bottom ones of the fire bricks 20. The air is preheated as it is in contact with the back wall 12 both as it travels up through the passage 72 and as it travels down the manifold 74. Some, a small fraction, of the air also flows through secondary air tubes 80 extending upwardly into the space in the stove above the fuel in the bottom thereof to complete the combustion of the hot gases as they flow toward stack outlet 82. The tubes 80 have substantial lengths thereof in the fire chamber area of the stove to preheat the secondary air flowing therethrough, and are welded to the back wall 12.

As best shown in FIGS. 2, 4 and 5, the chamber 74 is formed by the back 38, which is welded to the flanged side plates 84 bolted to the back wall 12. The top flange 37 fits to rear edge portion of the top 32. A back plate 88 forms a heated air passage 90 with the side walls 84 and the front wall 38 of the back. The back plate 88 has at its top a rolled deflector 92 directing heating air over the top 32 of the stove and past a triple wall or insulated stack pipe or chimney 94 and adapter ring 96 having holes 98 therethrough to cool the chimney.

With a blower or fan 100 having an insert 101 bolted to the bottom portions of the front wall 38 of the back, the back plate 88 and the side walls 84, and the electrical motor driven blower 104 operating, the heating air is blown upwardly through the passage 90. With the fan off, or with the entire blower removed, air flows upwardly through the passage 90 by convection.

The door 66 has pintle rods 100 extending through hinging slots 102 in a rolled hearth plate 105 welded to the front 36. The rods are attached to a cupped door front 106 to the inside face of which is welded a smaller, cupped member 108 with reflective heat insulation 110 filling the space thus formed. A resilient, asbestos gasket 112 is fixed in annular groove 114 and sealingly engages the door frame 68 when the door is held closed by a pair of latches 116 when the latches are in latching position. For fireplace operation, the latches are unlatched and the door may be swung to an open position and so held or may be completely removed. In either case, the holes 70 are open for flow of air for combustion from the pipes 60 and 62 through the holes 70 and the door frame 68 broken line arrow 107 showing the path of air through the holes 70 and the door frame 68. In the fireplace operation, the combustion is usually much faster than with the closed or stove operation, and the back wall 12 is heated more. This causes a bimetallic thermostat coil 120 to be hotter to turn damper shaft 122 to turn the damper plate 76 to fully or partially close the air inlet of the preheater manifold 74.

When the stove cools down as in a low combustion operation thereof, the flow of air from the fire chamber area through the stack pipe 94 is not sufficient to prevent condensation of tars, etc., commonly described as "creosoting". To prevent creosoting, a small aspirating pipe 130, preferably several feet in length, five feet being optimum, is supported in a centered position in the pipe 94 by an elbow 132 and a horizontal pipe 134 extending through back wall 12 into the passage 72. The members 130, 132 and 134 may be a one-piece, heat pipe, if desired. Air flows upwardly through the pipe 130 to create a draft and help flush out the creosote laden gases from the fire chamber area. This pipe also serves another function, that being the evacuation of smoke and gases which sometimes escape up the manifold from the bottom of the fire chamber when the door is removed.

In FIGS. 6–9, there is shown a stack construction 140 for connecting the pipe 94 to an insulated chimney pipe 142 fixed in the roof of the mobile home. A pipe or tube 144 has lower male end portion 146 fitting into the upper end portion of the pipe 94 and has annular grooves 148 and 150 into which furnace cement seals 152 and 154 are set to seal the upper end of the pipe 144 to the interior of the chimney pipe 142. This prevents leakage of the creosote to the outside of the pipe 144. To aid in preventing creosoting, an L-shaped air injection tube 156 leads from an entrance port 158 to the center of the pipe 144 and upwardly. A valve closure member 160 on a bimetallic arm 162 on the pipe 144 is moved by the arm to an open position when the pipe 144 is cool, as when the door is closed, to inject air into the pipe 144, and is moved to a closed position to close off air when the pipe 144 is hot and no aid for exhausting the gases is needed but may be needed when the door is open to keep vacuum action in the stove to prevent smoking out the open door. A protective band 164 loosely surrounds the arm 162 and valve closure member 160.

What is claimed is:

1. In a heater, a body having a fireplace door opening, a fireplace door hinged to the body for movement between a closed position and an open position, air-for-combustion passage means having an inlet connectible to the exterior of a room to be heated and also having a first outlet means leading to the interior of the body and second outlet means near the door opening leading to the exterior of the stove, and means operable by the door for closing the second outlet means when the door is closed and opening the second outlet means when the door is open.

2. The heater of claim 1 wherein the body has a front wall in which the opening is provided, the front wall also having outlet openings below the door forming the second outlet means, the door serving to close the outlet openings when in its closed position.

3. In a heater, a double-walled stove body having an air-for-combustion passage between the walls thereof having an inlet at the bottom of the body, an inlet passage between the walls and having an inlet opening at one end and an outlet into the interior of the body at its other end, the body having a front wall having a door opening, and fireplace door means adapted to close the door opening and movable to open the door opening to adapt the heater for fireplace mode of operation, the body having a second outlet from the inlet passage at the front of the body, the fireplace door means closing the second outlet when in a position closing the door opening and opening the second outlet when opened.

4. The heater of claim 3 including tubular stack means leading from the interior of the body, and an air injection pipe means having an inlet outside the interior of the stove body and extending along the stack means.

5. The heater of claim 4 wherein the injection pipe means is completely exterior of the stove body and including thermostat controlled valve means responsive to temperature of the stack means for closing the injection pipe means whenever the temperature of the stack means is raised to a predetermined value.

6. The heater of claim 3 wherein the inlet of the injection pipe means is in the air-for-combustion passage.

7. In a heater, stove body means defining a fire chamber and having a double-wall back and a double-wall bottom having an air inlet therein and connected for air flow to the interior of the double-wall back, the double-wall back having a combustion air inlet from the interior thereof into a fire chamber in the body means, a downdraft manifold in the double-wall back and connecting the interior of the back to the inlet to the fire chamber, the double-wall bottom having an outlet at the front of the body means, the body having a front provided with a fireplace door opening, and a fireplace door movable from a closed position closing the door opening and the outlet and an open position opening the door opening and the outlet.

8. In a heater, stove body means defining a fire chamber and having a double-wall back and a double-wall bottom having an air inlet therein and connected for air flow to the interior of the double-wall back, the double wall-back having a combustion air inlet from the interior thereof into a fire chamber in the body means, the double-wall bottom having an outlet at the front of the body means, the body means having a front provided with a fireplace door opening, and a fireplace door movable from a closed position closing the door opening and the outlet to open the door opening and the outlet.

9. In a heater, heater body means having a stack outlet, a stack pipe connected to the outlet and having a vertical portion, an injection tube extending into the vertical portion of the stack pipe from the exterior of the stack and directing air upwardly in the stack, the tube extending through the wall of the pipe, a valve closure member, and bimetallic means mounting the valve closure member on the stack for moving the closure member to close the tube when the stack is hot and moving the closure member to open the tube when the stack is cool, the valve closure member including a looped guard spaced from and covering the opening, a bimetallic member between the guard and the stack and a valve closure member carried by the bimetallic member.

* * * * *